US007849555B2

(12) United States Patent
Hahm et al.

(10) Patent No.: US 7,849,555 B2
(45) Date of Patent: Dec. 14, 2010

(54) ROBOT CLEANING SYSTEM AND DUST REMOVING METHOD OF THE SAME

(75) Inventors: Jung Yoon Hahm, Seoul (KR); Eduard Kurgi, Suwon-si (KR); Hoon Wee, Yongin-si (KR); Jin Ha Jeong, Yongin-si (KR); Jae Man Joo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1022 days.

(21) Appl. No.: 11/644,934

(22) Filed: Dec. 26, 2006

(65) Prior Publication Data

US 2007/0245511 A1 Oct. 25, 2007

(30) Foreign Application Priority Data

Apr. 24, 2006 (KR) ..... 10-2006-0036674

(51) Int. Cl.
*A47L 9/28* (2006.01)

(52) U.S. Cl. ..... 15/319; 15/304; 15/306.1; 15/309.2; 15/339; 15/352; 134/21

(58) Field of Classification Search ..... 15/301, 15/303, 304, 306.1, 309.2, 319, 339, 352; 134/21; *A47L 9/28*
See application file for complete search history.

(56) References Cited

U.S. PATENT DOCUMENTS

| | | | |
|---|---|---|---|
| 6,076,226 | A | 6/2000 | Reed |
| 2005/0150519 | A1 | 7/2005 | Keppler et al. |
| 2007/0050937 | A1 * | 3/2007 | Song et al. ..... 15/319 |

FOREIGN PATENT DOCUMENTS

| | | | |
|---|---|---|---|
| CN | 1665438 | A | 9/2005 |

* cited by examiner

*Primary Examiner*—David A Redding
(74) *Attorney, Agent, or Firm*—Staas & Halsey LLP

(57) ABSTRACT

A robot cleaning system and a dust removing method of the same that are capable of moving a first dust collector mounted in a robot cleaner to a docking station to remove dust collected in the first dust collector. The robot cleaning system includes a robot cleaner having an opening, though which a first dust collector to collect suctioned dust is carried in and out of the robot cleaner, a docking station, to which the robot cleaner is docked to remove the dust collected in the first dust collector, and a collector moving unit to move the first dust collector to the docking station.

34 Claims, 8 Drawing Sheets

ROBOT CLEANING SYSTEM AND DUST REMOVING METHOD OF THE SAME

CROSS-REFERENCE TO RELATED APPLICATIONS

This application claims the benefit of Korean Patent Application No. 2006-36674, filed on Apr. 24, 2006 in the Korean Intellectual Property Office, the disclosure of which is incorporated herein by reference.

BACKGROUND OF THE INVENTION

1. Field of the Invention

The present application relates to a robot cleaning system and a dust removing method of the same, and, more particularly, to a robot cleaning system and a dust removing method of the same that are capable of moving a first dust collector mounted in a robot cleaner to a docking station so as to remove dust collected in the first dust collector.

2. Description of the Related Art

A cleaner is an apparatus for cleaning a room and is typically used to remove dust. A typical example of cleaner is a vacuum cleaner that suctions foreign matter, such as dust, dirt, and loose debris, using a suction force of a suction unit.

In recent years, robot cleaners have been developed that remove foreign matter, such as dust and loose debris, from a floor while moving though an automatic moving function. Each of these robot cleaners constitutes a system together with a station that is located at a specific position in the room to charge the robot cleaner or to remove dust collected in the robot cleaner (hereinafter, referred to as a "docking station").

An example of a robot cleaning system is disclosed in U.S. Patent Publication No. 2005/0150519.

In the disclosed robot cleaner system, a small-sized dust collector is mounted in a robot cleaner, and a large-sized dust collector is mounted in a docking station. When an amount of dust collected in the dust collector of the robot cleaner exceeds a predetermined amount of dust when the robot cleaner is operating automatically, the robot cleaner returns to the docking station, and is docked to the docking station such that the dust collected in the dust collector of the robot cleaner is automatically discharged into the dust collector of the docking station.

When the robot cleaner moves upward along an incline formed at the lower part of the docking station, and reaches a docking position, in order to remove the dust collected in the dust collector of the robot cleaner, a discharge port of the robot cleaner faces a suction port of the docking station. In this state, a suction unit of the docking station is operated to suck the dust collected in the dust collector of the robot cleaner into the dust collector of the docking station.

However, in the conventional robot cleaner system, a suction channel, which the collects dust in the dust collector of the robot cleaner and suctions the dust into the dust collector of the docking station, is long. Therefore, there is a possibility that bulky debris, such as hair, is caught in the suction channel.

In addition, the conventional robot cleaner must be docked to the docking station until all of the dust collected in the dust collector of the robot cleaner is discharged.

Also, the dust collector and the suction unit must be mounted in the docking station, which increases the volume and size of the docking station.

Furthermore, if the suction unit of the docking station and the discharge port of the robot cleaner are not in tight contact during operation, some of the dust discharged from the robot cleaner is not suctioned into the dust collector of the docking station, but is discharged into the room. Thus, the collected dust and debris are spread through the room and the air in the room is contaminated.

SUMMARY OF THE INVENTION

Therefore, it is an aspect of the application to provide a robot cleaning system to decrease the total length of a suction channel, through which dust is suctioned from a dust collector of a robot cleaner to a dust collector of a docking station.

It is another aspect of the application to provide a robot cleaning system wherein the robot cleaner can perform cleaning without being docked to the docking station until the dust collected in the dust collector of the robot cleaner is discharged.

It is another aspect of the application to provide a robot cleaning system without a dust collector and suction unit mounted in the docking station in order to reduce the size of the docking station.

It is yet another aspect of the application to provide a robot cleaning system where the dust collector of the robot cleaner can be automatically exchanged, and therefore, the leakage and spillage of dust that occurs when dust is suctioned from the dust collector of the robot cleaner to the dust collector of the docking station is effectively prevented.

Additional aspects and/or advantages of the application will be set forth in part in the description which follows and, in part, will be apparent from the description, or may be learned by practice of the application.

In accordance with one aspect, the present application provides a robot cleaning system, including: a robot cleaner having a first dust collector to collect suctioned dust and an opening to carry the first dust collector in and out of the robot cleaner; a docking station to dock the robot cleaner in order to remove the dust collected in the first dust collector; and a collector moving unit to move the first dust collector to the docking station.

The collector moving unit may include an actuator, a connection part connected to a rotary shaft of the actuator, and a first coupling part extending from the connection part in the radial direction to be coupled with the first dust collector.

The docking station may include a second dust collector to suction dust in the first dust collector, and a guide member to guide the coupling between the first port of the first dust collector and the suction port of the second dust collector when the collector moving unit rotates and moves the first dust collector to the docking station.

The guide member may have a location part, on which a third dust collector is located, the third dust collector having the same size and shape as the first dust collector and being coupled with the second dust collector.

The collector moving unit may further include a second coupling part extending from the connection part in the direction opposite to the first coupling part, wherein the first dust collector is moved to the docking station, and the third dust collector is moved to the robot cleaner such that the dust collectors are exchanged.

The first coupling part and the second coupling part have attaching and detaching members to attach and detach the first dust collector and the third dust collector to and from the first coupling part and the second coupling part, respectively.

The attaching and detaching members are electromagnets, and the first dust collector and the third dust collector have metal members formed at predetermined positions thereof, the metal members being attached to and detached from the corresponding attaching and detaching members.

The docking station includes a loading table, on which a plurality of exchangeable dust collectors are loaded such that the first dust collector can be exchanged for one of the exchangeable dust collectors, and a discarding table, from which the first dust collector, which has been moved from the robot cleaner to the docking station by the collector moving unit, is discarded, and the collector moving unit moves the first dust collector to the discarding table, and mounts one of the exchangeable dust collectors in the robot cleaner, wherein the first dust collector is exchanged.

The collector moving unit further includes second and third coupling parts, which are arranged such that the second and third coupling parts are arranged at intervals of 120 degrees with the first coupling part about the connection part.

The respective coupling parts have attaching and detaching members to attach and detach the first dust collector and the exchangeable dust collector to and from the respective coupling parts.

The first dust collector and the exchangeable dust collectors are disposable dust bags.

The docking station further includes a conveyor to convey the first dust collector after being removed from the robot cleaner and moved to the discarding table, to a disposal area.

The first dust collector and the exchangeable dust collector are constructed in the shape of an arc constituting a portion of a circumference having the connection part as the center thereof.

In accordance with another aspect, the present application provides a robot cleaning system, including: a robot cleaner having a first dust collector to collect suctioned dust and an opening, though which the first dust collector is carried in and out of the robot cleaner; a docking station having a second dust collector to suction the dust in the first dust collector when the robot cleaner is docked to the docking station; and a collector moving unit to move the first dust collector such that a first port of the first dust collector is coupled to a suction port of the second dust collector.

The collector moving unit includes an actuator, a connection part connected to a rotary shaft of the actuator, and a first coupling part extending from the connection part in the radial direction to be coupled with the first dust collector, whereby the collector moving unit rotates and moves the first dust collector.

In accordance with another aspect, the present application provides a robot cleaning system including: a robot cleaner having a first dust collector to collect suctioned dust; a docking station having a second dust collector to collect suctioned dust; a third dust collector located on the docking station and coupled to the second dust collector; and a collector moving unit to exchange the first dust collector and the third dust collector when the robot cleaner is docked to the docking station.

The collector moving unit includes an actuator, a connection part connected to a rotary shaft of the actuator, a first coupling part extending from the connection part in the radial direction to be coupled with the first dust collector, and a second coupling part extending from the connection part in the direction opposite to the first coupling part, the second coupling part being coupled to the third dust collector.

The respective coupling parts have attaching and detaching members to attach and detach the first dust collector and the third dust collector to and from the respective coupling parts.

The attaching and detaching members are electromagnets, and the first dust collector and the third dust collector have metal members formed at predetermined positions thereof, the metal members being attached to and detached from the corresponding attaching and detaching members.

In accordance with another aspect, the present application provides a robot cleaning system, includes: a robot cleaner having a first dust collector to collect suctioned dust; a docking station having a loading table, on which a plurality of exchangeable dust collectors are loaded, and a discarding table, from which the first dust collector, which has been moved from the robot cleaner to the docking station, is discarded; and a collector moving unit to move the first dust collector to the discarding table and move one of the exchangeable dust collectors to the robot cleaner.

The collector moving unit includes an actuator, a connection part connected to a rotary shaft of the actuator, and first, second, and third coupling parts extending from the connection part in the radial direction and arranged at intervals of 120 degrees.

The respective coupling parts have attaching and detaching members to attach and detach the first dust collector and the exchangeable dust collector to and from the respective coupling parts.

The first dust collector and the exchangeable dust collectors are disposable dust bags.

In accordance with another aspect, the present application provides a dust removing method of a robot cleaning system, including: determining whether a predetermined amount of dust has been collected in a first dust collector mounted in a robot cleaner; moving the robot cleaner to a docking station; determining whether the robot cleaner has been docked to the docking station; moving the first dust collector to the docking station such that the first dust collector communicates with a second dust collector mounted in the docking station, operating a second suction unit such that the dust in the first dust collector is suctioned into the second dust collector; determining whether the dust in the first dust collector has been removed; and controlling the second suction unit not to be operated, and moving the first dust collector to the robot cleaner.

In accordance with another aspect, the present application provides a dust removing method of a robot cleaning system, including: determining whether a predetermined amount of dust has been collected in a first dust collector mounted in a robot cleaner; moving the robot cleaner to a docking station; and exchanging the dust collector mounted in the robot cleaner for a dust collector located on the docking station using a collector moving unit mounted in the robot cleaner.

The exchanging the dust collector mounted in the robot cleaner for the dust collector located on the docking station includes: coupling the dust collector located on the docking station to the collector moving unit; rotating the dust collector mounted in the robot cleaner and the dust collector located on the docking station using the collector moving unit; and separating the dust collector mounted in the robot cleaner from the collector moving unit.

The method further includes: suctioning dust from the dust collector of the robot cleaner, which has been moved to the docking station, into a dust collector mounted in the docking station.

In accordance with yet another aspect, the present application provides a dust removing method of a robot cleaning system, including: determining whether a predetermined amount of dust has been collected in a first dust collector mounted in a robot cleaner; moving the robot cleaner to a docking station; moving the first dust collector to the docking station and moving an exchangeable dust collector mounted in the docking station to the robot cleaner such that the dust collectors are exchanged; and conveying the first dust collector, which has been moved to the docking station, to a disposal area.

Additional aspects and/or advantages of the application will be set forth in part in the description which follows and, in part, will be obvious from the description, or may be learned by practice of the application.

BRIEF DESCRIPTION OF THE DRAWINGS

These and/or other aspects and advantages of the application will become apparent and more readily appreciated from the following description of the embodiments, taken in conjunction with the accompanying drawings, of which.

DETAILED DESCRIPTION OF THE PREFERRED EMBODIMENTS

Figure 1:
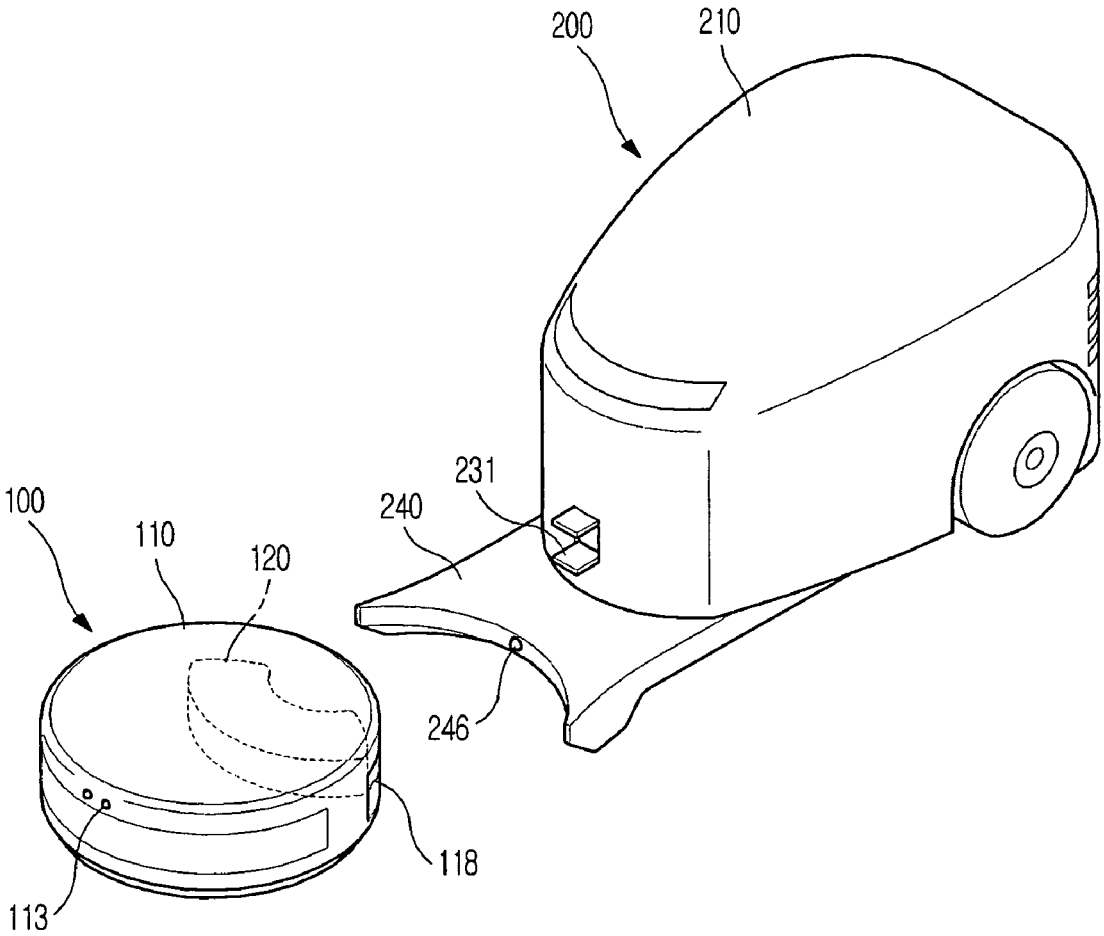
FIG. 1 is a perspective view illustrating a robot cleaning system according to a first embodiment of the present application.

Reference will now be made in detail to the embodiments of the present application, examples of which are illustrated in the accompanying drawings, wherein like reference numerals refer to like elements throughout. The embodiments are described below to explain the present application by referring to the figures.

Figure 2:
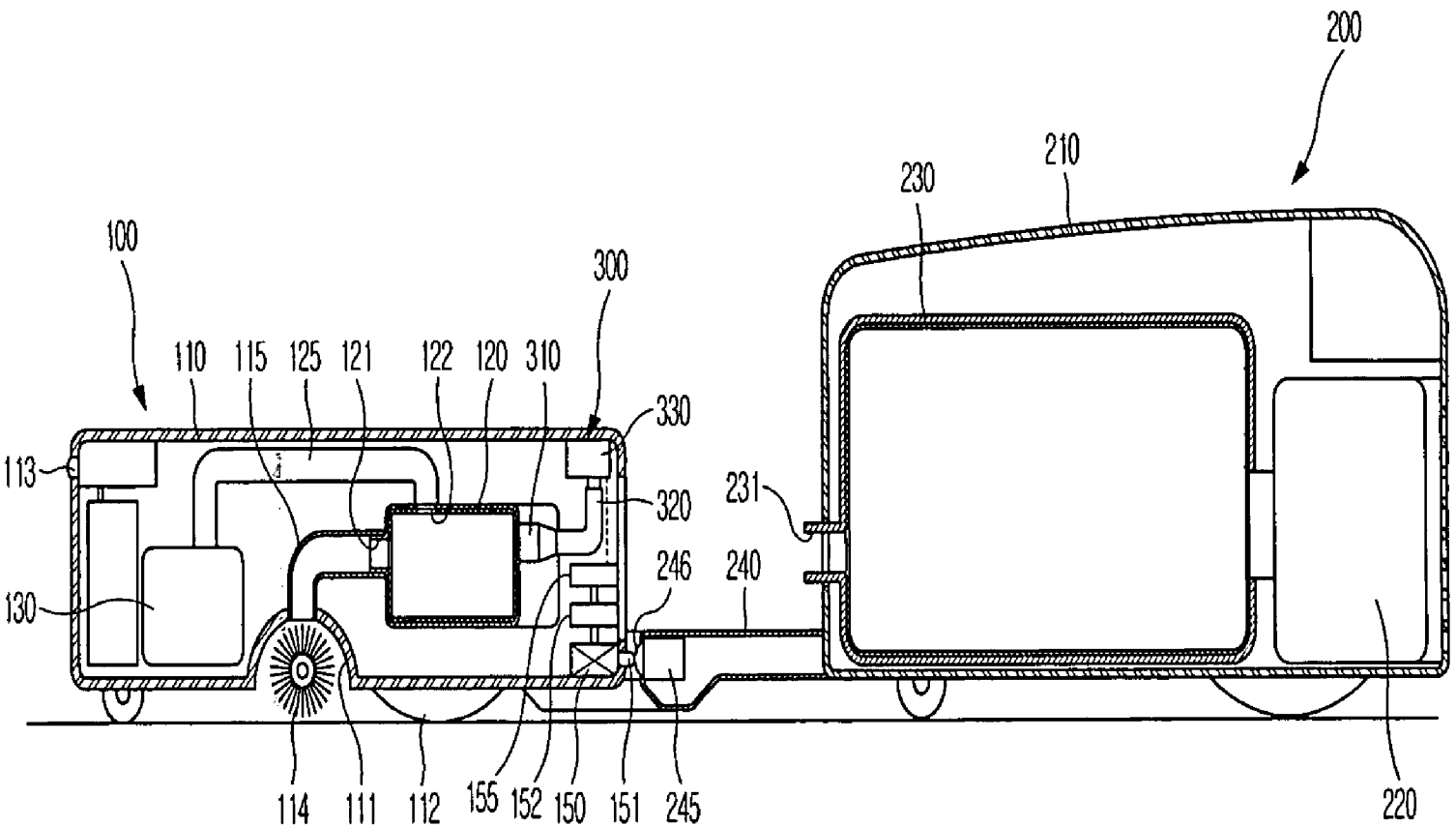
FIGS. 2 and 3 are sectional views of the robot cleaning system shown in FIG. 1.
Figure 3:
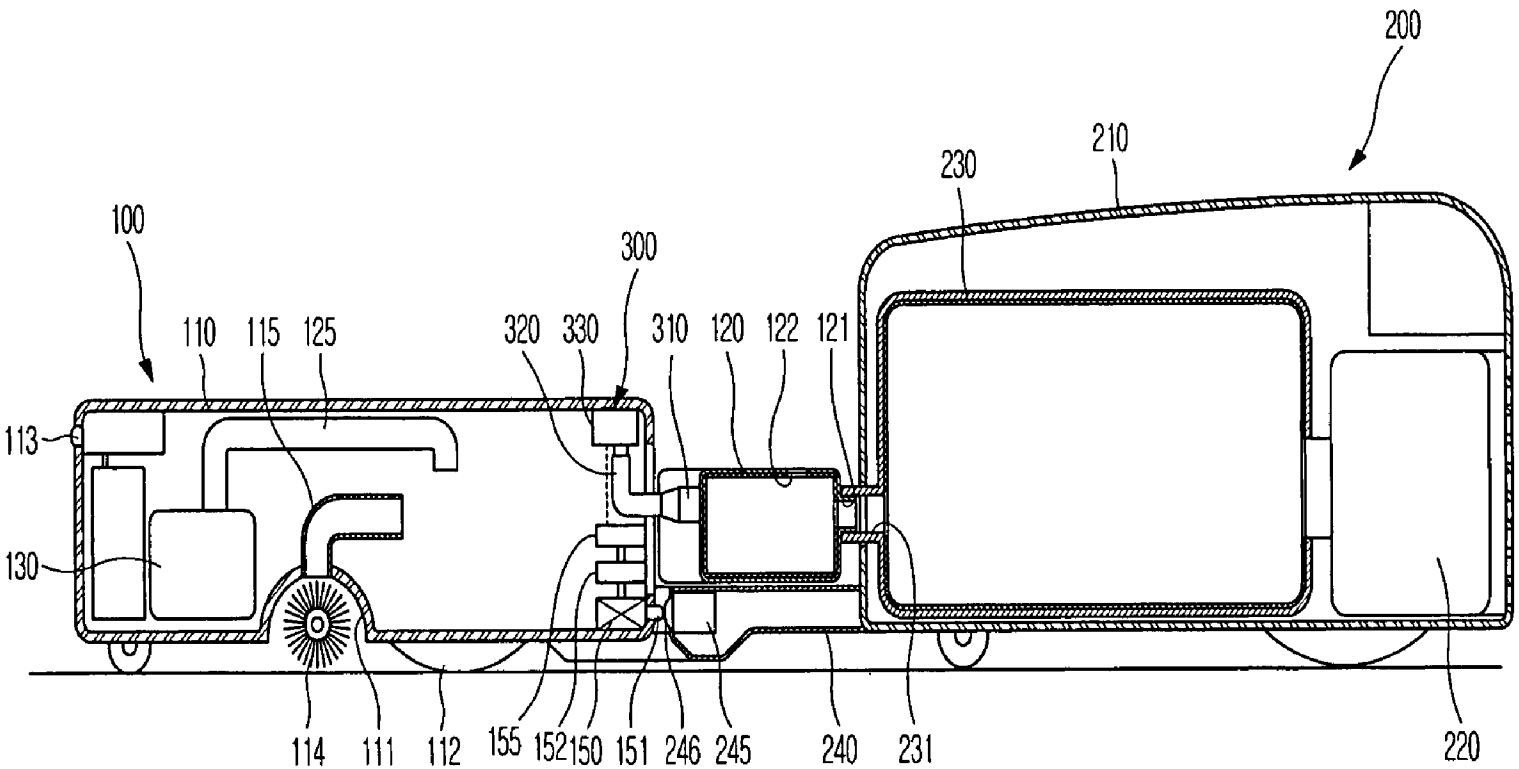

As shown in FIGS. 1 to 3, a robot cleaning system according to a first embodiment of the present application includes a robot cleaner 100 to suction dust and a docking station 200. The robot cleaner 100 is docked when a predetermined amount of dust is collected in a first dust collector 120 mounted inside the robot cleaner 100 or when a rechargeable battery 150 needs to be charged.

The robot cleaner 100 includes a robot body 110 having a suction port 111 formed at the lower part thereof to suction dust, a first dust collector 120 mounted in the robot body 110 to collect the suctioned dust, and a first suction unit 130 communicating with the first dust collector 120 to generate a suction force necessary to suction the dust. At the suction port 111 is rotatably mounted a brush 114 to sweep the dust.

Although not shown in the drawings, the first suction unit 130 includes a motor to generate a driving force and a blowing fan receiving the driving force of the motor to generate a blowing force. In the robot body 110, a dust amount detecting sensor is mounted to detect the amount of dust collected in the first dust collector 120.

The suction port 111, through which the dust is suctioned, is connected to a first port 121 of the first dust collector 120 via a first duct 115. A second port 122 of the first dust collector 120 is connected to the first suction unit 130 via a second duct 125. Consequently, one channel is formed from the suction port 111 to the first suction unit 130. The first duct 115 is cut off at opposite sides of the end thereof where the first port 121 of the first dust collector 120 is inserted such that, when the first port 121 is rotated, the first port 121 can be separated from the first duct 115.

At the bottom of the robot body 110 are mounted a pair of electric-powered wheels 112, by which the robot cleaner 100 is moved. The pair of electric-powered wheels 112 is selectively driven by driving motors (not shown) to rotate the respective electric-powered wheels 112 such that the robot cleaner 100 can perform a linear movement and a rotary movement. At the outside of the robot body 110 is mounted an obstacle detecting sensor 113, such as an infrared sensor or an ultrasonic sensor, such that the robot cleaner 100 can avoid obstacles.

On the other hand, the robot cleaner 100 has a rechargeable battery 150 to supply power necessary to operate the robot cleaner 100. A connection terminal 151 is connected to the rechargeable battery 150, such that the connection terminal 151 protrudes outward from the robot body 110 and the rechargeable battery 150 can be charged when the robot cleaner 110 is docked to the docking station 200. A connection detector 152 is also connected to the rechargeable battery 150 to detect whether the connection terminal 151 has been connected to a connection terminal 246 of the docking station 200, which will be described below.

The connection detector 152 is connected to a controller 155 such that the detection between the connection terminal 151 of the robot cleaner 100 and the connection terminal 246 of the docking station 200 is transmitted to the controller 155.

When performing a cleaning operation, the robot cleaner 100 automatically moves in a zone. When a predetermined amount of dust is collected in the first dust collector 120 or the rechargeable battery 150 is to be charged, the robot cleaner 100 automatically returns to the docking station 200.

The docking station 200 includes a station body 210, a second suction unit 220 mounted in the station body 200 to generate a suction force necessary to suction dust from the first dust collector 120, and a second dust collector 230 to collect the dust suctioned from the first dust collector 120. A suction port 231 to suction dust is formed on the second dust collector 230. Opposite sides of the suction port 231 are open such that the first port 121 of the first dust collector 120 can be rotatably inserted into the suction port 231.

A guide member 240 to guide the docking of the robot cleaner 100 is disposed in front of the docking station 200. A charging unit 245 having a connection terminal 246 to charge the rechargeable battery 150 of the robot cleaner 100 is mounted on the guide member 240.

In the robot body 110 is mounted a collector moving unit 300, which moves the first dust collector 120 to the docking station 200 so as to remove dust collected in the first dust collector 120 when the robot cleaner 100 is docked to the docking stating 200. The collector moving unit 300 includes an actuator 330 constructed to be operated according to an operation signal of the controller 155, a connection part 320 connected to a rotary shaft of the actuator 330, and a first coupling part 310 extending from the connection part 320 in the radial direction to be coupled with the first dust collector 120.

The collector moving unit 300 is provided to reduce the total length of a suction channel, through which the dust is suctioned, when the dust collected in the first dust collector 120 is suctioned into the second dust collector 230, by carrying the first dust collector 120 out of the robot cleaner and having the first dust collector 120 directly communicate with the second dust collector mounted in the docking station 200. On the other hand, the robot body 110 has an opening 118, through which the collector moving unit 300 carries the first dust collector 120 out of or into the robot body 110.

Hereinafter, the operation of the robot cleaning system according to the first embodiment of the present application will be described with reference to FIGS. 3 and 4.

Figure 4:
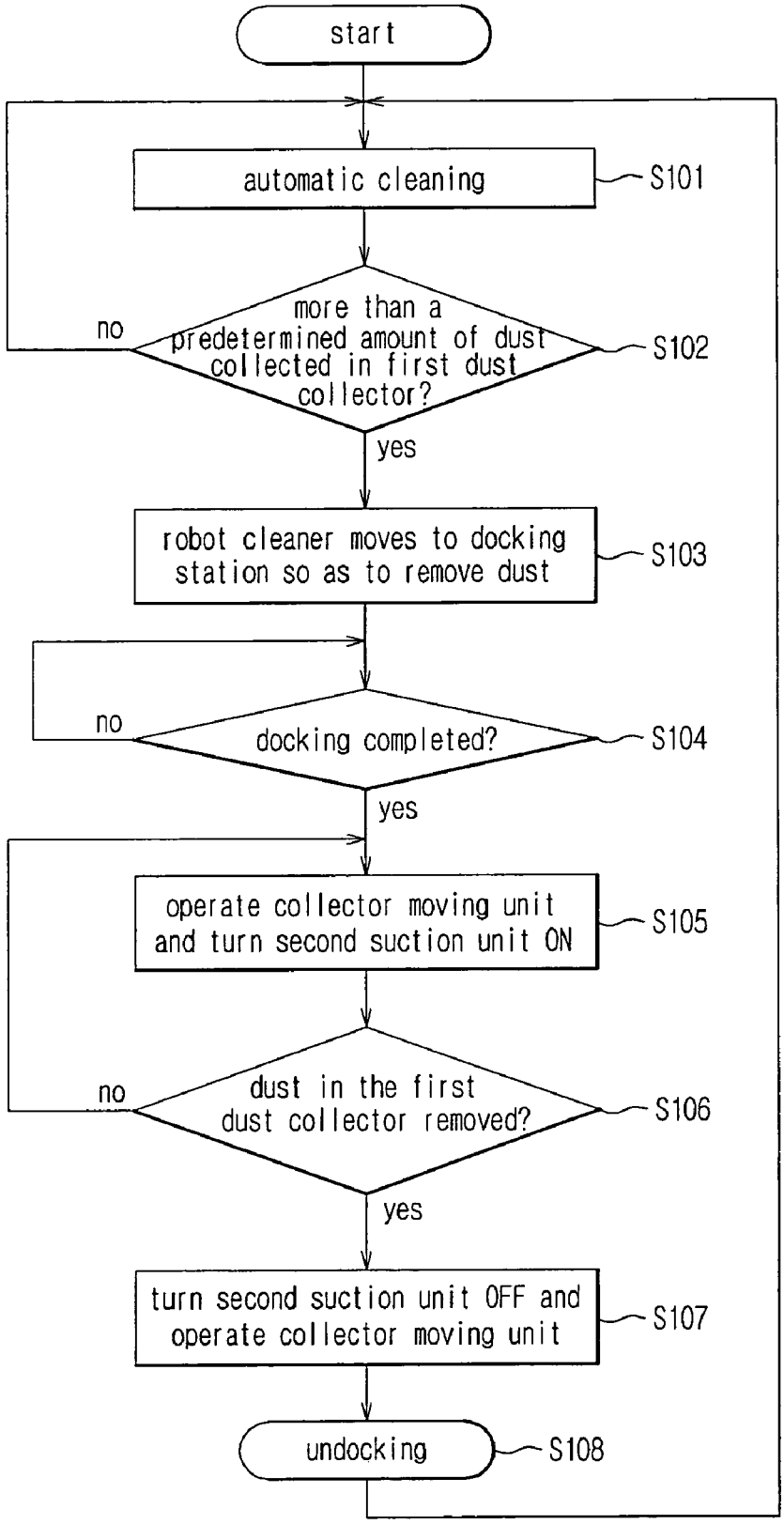
FIG. 4 is a flow chart illustrating the operation of the robot cleaning system shown in FIG. 1.

FIG. 3 is a sectional view illustrating the direct communication between the first dust collector 120 and the second dust collector 230 accomplished by moving the first dust collector 120 to the docking station 200, and FIG. 4 is a flow chart illustrating the operation of the robot cleaning system.

When a cleaning operation is initiated, the robot cleaner 100 cleans foreign matter in a zone to be cleaned while the robot cleaner 100 is automatically moving. At this time, the suction force of the first suction unit 130 is applied to the first port 121 of the first dust collector 120, whereby dust on the floor is collected into the first dust collector 120 (S101).

During the automatic cleaning, the dust amount detecting sensor (not shown) in the robot cleaner 100 detects the amount of dust collected in the first dust collector 120 and transmits related data to the controller 155, which determines whether more than a predetermined amount of dust has been collected in the first dust collector 120 (S102).

When it is determined that more than the predetermined amount of dust has been collected in the first dust collector 120, the robot cleaner 100 stops the cleaning operation and moves to the docking station 200 to remove the collected dust (S103). The construction and operation of returning the robot cleaner 100 to the docking station 200 is well known, and therefore, a detailed description thereof will not be given.

When the robot cleaner 100 is docked to the docking station 200, the connection terminal 151 of the robot cleaner 100 is connected with the connection terminal 246 of the docking station 200. The connection detector 152 detects the connection between the robot cleaner 100 and the docking station 200 and transmits a related signal to the controller 155. The controller 155 determines whether the docking operation of the robot cleaner 100 has been completed based on the signal transmitted from the connection detector 152 (S104).

When the controller 155 determines that the docking operation of the robot cleaner 100 has been completed, the controller 155 operates the collector moving unit 300 such that the first dust collector 120 is rotated 180 degrees about the connection part 320. When the first port 121 of the first dust collector 120 is inserted into the suction port 231 of the docking station 200, the controller 155 controls the second suction unit 220 to be operated (S105).

As the second suction unit 200 is operated, dust in the first dust collector 120 is removed little by little. The dust amount detecting sensor (not shown) in the robot cleaner 100 detects the amount of dust collected in the first dust collector 120 and transmits related data to the controller 155, which determines whether the dust in the first dust collector 120 has been removed (S106). When the controller 155 determines that the dust in the first dust collector 120 has been removed, the controller 155 stops the operation of the second suction unit 220 and operates the collector moving unit 300 such that the first dust collector 120 is carried in the robot cleaner 100 (S107).

When the dust removing process has been completed, the robot cleaner 100 is undocked from the docking station 200, and then resumes the automatic cleaning (S108).

The robot cleaner completely cleans dust in the room by repeating the dust removing process.

As described above, the first dust collector 120 is moved to the docking station 200 such that the first dust collector 120 directly communicates with the second dust collector 230, and then the dust collected in the first dust collector 120 is suctioned into the second dust collector 230. Consequently, the total length of the suction channel, through which the dust is suctioned, is decreased.

Figure 5:
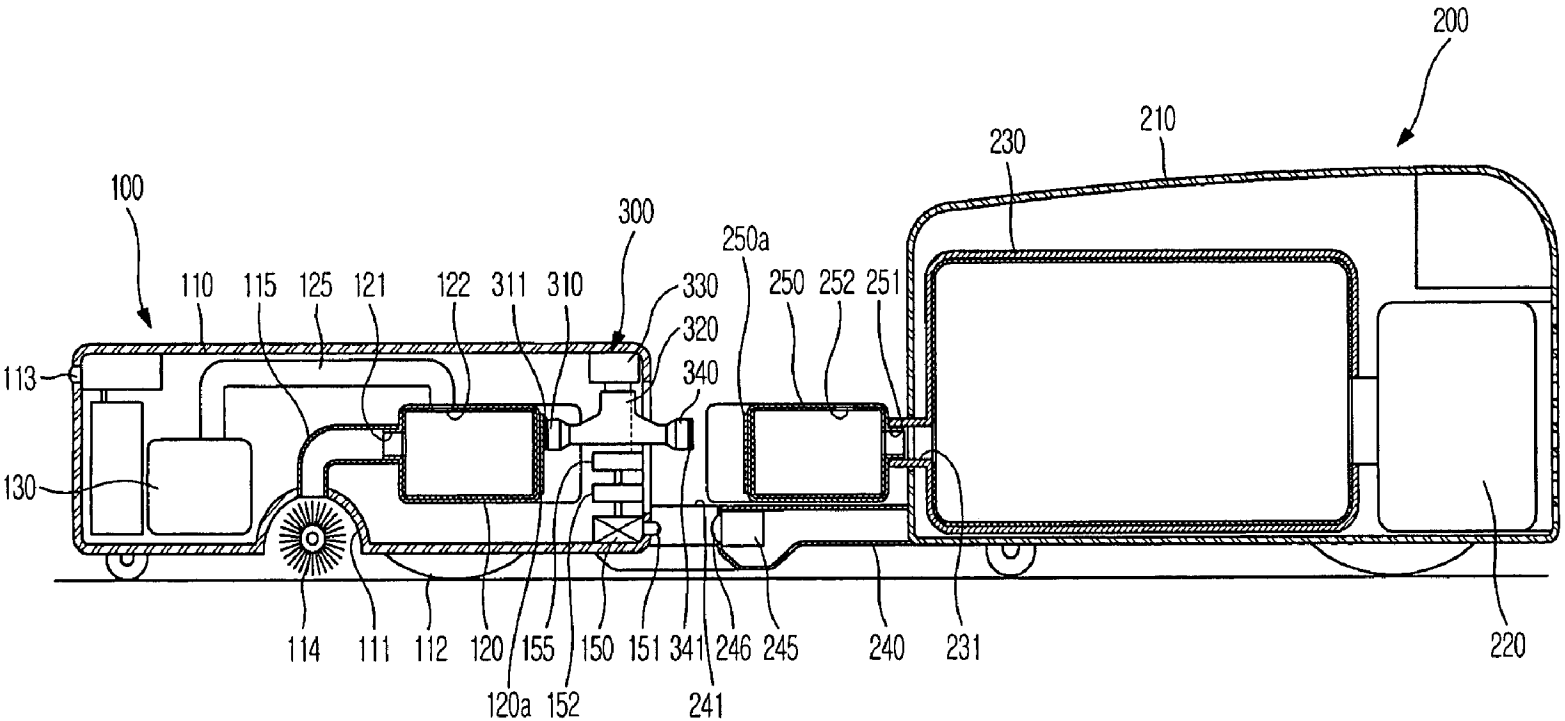
FIG. 5 is a sectional view illustrating a robot cleaning system according to a second embodiment of the present application.
Figure 6:
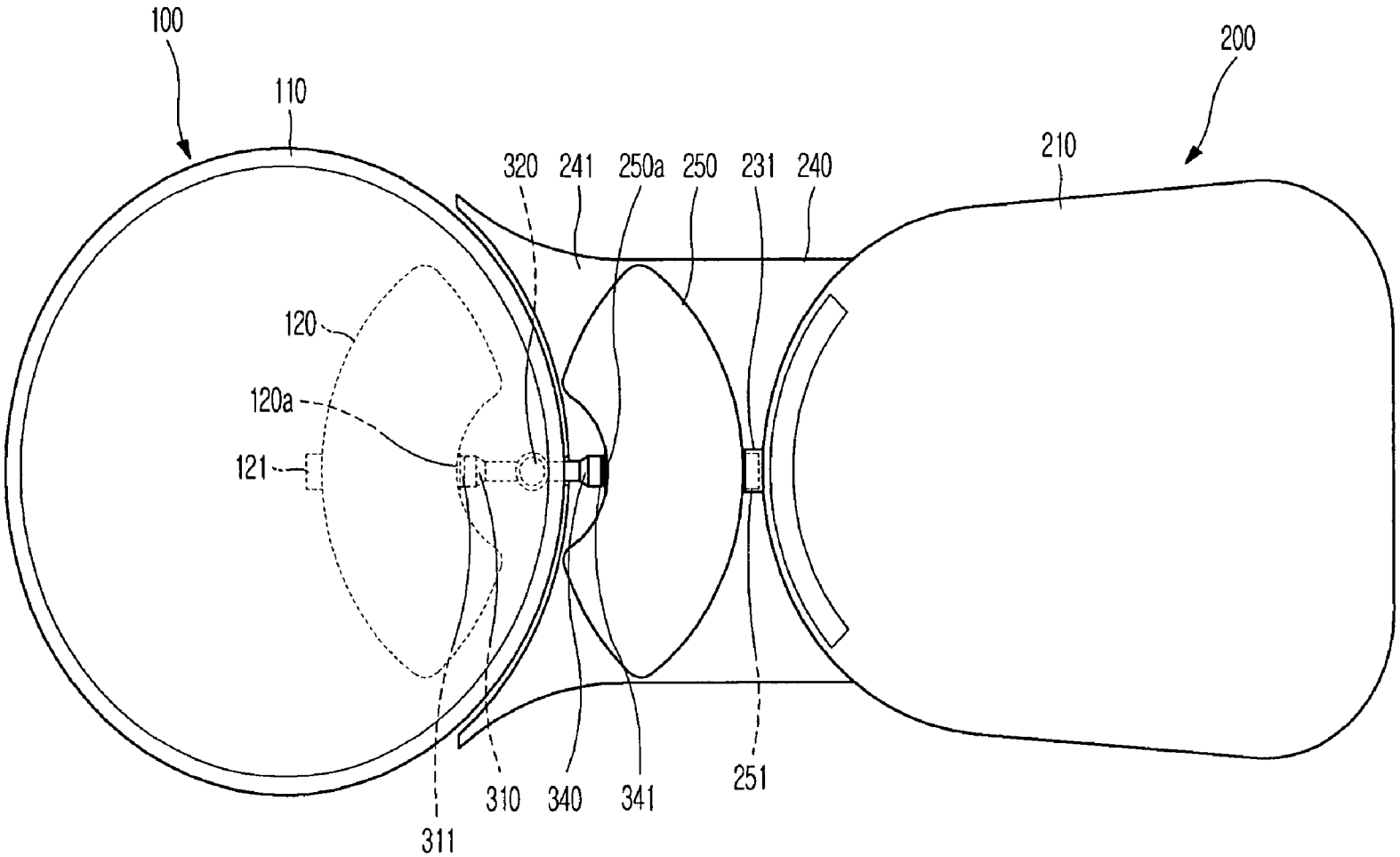
FIG. 6 is a plan view of the robot cleaning system shown in FIG. 5.

FIGS. 5 and 6 illustrate a robot cleaning system according to a second embodiment of the present application. Elements of the robot cleaning system according to the second embodiment, which are identical to those of the robot cleaning system according to the first embodiment, are denoted by the same reference numerals, and a description thereof will not be given.

As shown in FIG. 5, the robot cleaning system according to the second embodiment includes a collector moving unit 300 to exchange a first dust collector 120 mounted in a robot cleaner 100 for a third dust collector 250 located on a docking station 200 so as to remove dust collected in the first dust collector 120 when the robot cleaner 100 is docked to the docking station 200.

At the upper surface of a guide member 240 is provided a location part 241, on which the third dust collector 250 is located. The third dust collector 250 has the same size and shape as the first dust collector 120. Also, the third dust collector 250 has a first port 251 and a second port 252 like the first dust collector 120. The first dust collector 120 and the third dust collector 250 are constructed in the shape of an arc constituting a portion of a circumference having a connection part 320 of the collector moving unit 300 as the center thereof.

When the third dust collector 250 is located on the docking station 200, the first port 251 of the third dust collector 250 is coupled to a suction port 231 of a second dust collector 230, and a second suction unit 220 is operated to completely remove dust in the third dust collector 250.

The collector moving unit 300 includes an actuator 330, a connection part 320 connected to a rotary shaft of the actuator 330, a first coupling part 310 extending from the connection part 320 in the radial direction to be coupled with the first dust collector 120, and a second coupling part 340 extending from the connection part 320 in the direction opposite to the first coupling part 310.

Specifically, the first coupling part 310 and the second coupling part 340 are mounted such that the first coupling part 310 and the second coupling part 340 can be rotated about the connection part 320, which is rotated by the actuator 330.

At the first coupling part 310 is mounted a first attaching and detaching member 311 to attach and detach the first dust collector 120 to and from the first coupling part 310. At the second coupling part 340 is mounted a second attaching and detaching member 341 to attach and detach the third dust collector 250 to and from the second coupling part 340. In this embodiment, the first and second attaching and detaching members 311 and 341 are electromagnets, which are magnetized when current is supplied to the electromagnets and are not magnetized when current is not supplied to the electromagnets.

Also, the first dust collector 120 mounted in the robot cleaner 100 and the third dust collector 250 mounted in the docking station 200 have metal members 120*a* and 250*a*, respectively, which are attached to or detached from the first coupling part 310 and the second coupling part 340, respectively.

Hereinafter, the operation of the robot cleaning system according to the second embodiment of the present application will be described with reference to FIG. 6.

When the robot cleaner 100 moves to perform cleaning, the first attaching and detaching member 311 is magnetized, and therefore, the first dust collector 120 is coupled to the first coupling part 310.

When a dust amount detecting sensor detects that a predetermined amount of dust has been collected in the first dust collector 120 of the robot cleaner 100, the robot cleaner 100 returns to the docking station 200. When the robot cleaner 100 returns to a predetermined position, and a connection detector 152 detects that a connection terminal 151 of the robot cleaner 100 has been connected with a connection terminal 246 of the docking station 200, a controller 155 controls electric current to be supplied to the second attaching and detaching member 341. When the electric current is supplied to the second attaching and detaching member 341, the second attaching and detaching member 341 is magnetized, and therefore, the third dust collector 250 is coupled to the second coupling part 340.

While the first and third dust collectors 120 and 250 are coupled to the first and second coupling parts 310 and 340, respectively, the actuator 330 of the collector moving unit 300 is operated to rotate the first and second coupling parts 310 and 340 by 180 degrees about the connection part 320. As a result, the first dust collector 120 mounted in the robot cleaner 100 is moved to the docking station 200, and the third dust collector 250 mounted in the docking station 200 is moved to the robot cleaner 100. Consequently, the two dust collectors 120 and 250 are exchanged.

When the first dust collector 120 is moved to the docking station 200, a first port 121 of the first dust collector 120 is coupled to the suction port 231 of the second dust collector 230. When the third dust collector 250 is moved to the robot cleaner 100, the first port 251 of the third dust collector 250 is coupled to a first duct 115.

In this state, the controller 155 controls electric current to not be supplied to the first attaching and detaching member 311. When the electric current is not supplied to the first attaching and detaching member 311, the first attaching and detaching member 311 is not magnetized. As a result, the first dust collector 120 is separated from the first coupling part 310. Subsequently, the robot cleaner 100 freely moves to clean dust on the floor while the third dust collector 250, which is empty, is mounted in the robot cleaner 100.

On the other hand, when the first dust collector 120, in which dust is collected, is located on the docking station 200, and then the second suction unit 220 is operated, the dust collected in the first dust collector 120 is suctioned into the second dust collector 230. As a result, the first dust collector 120 becomes empty.

When a predetermined amount of dust is collected in the third dust collector 250 of the robot cleaner 100, and thus, the dust must be removed from the third dust collector 250, the robot cleaner 100 returns to the docking station 200, and the collector moving unit 300 exchanges the third dust collector 250 containing the collected dust with the first dust collector 120, which is empty, in the same manner as described above.

The robot cleaning system according to the second embodiment, in which the first dust collector 120 and the third dust collector 250 are exchanged, has an advantage in that it is possible for the robot cleaner to immediately perform cleaning without being docked to the docking station until the dust collected in the dust collector of the robot cleaner is removed.

Figure 7:
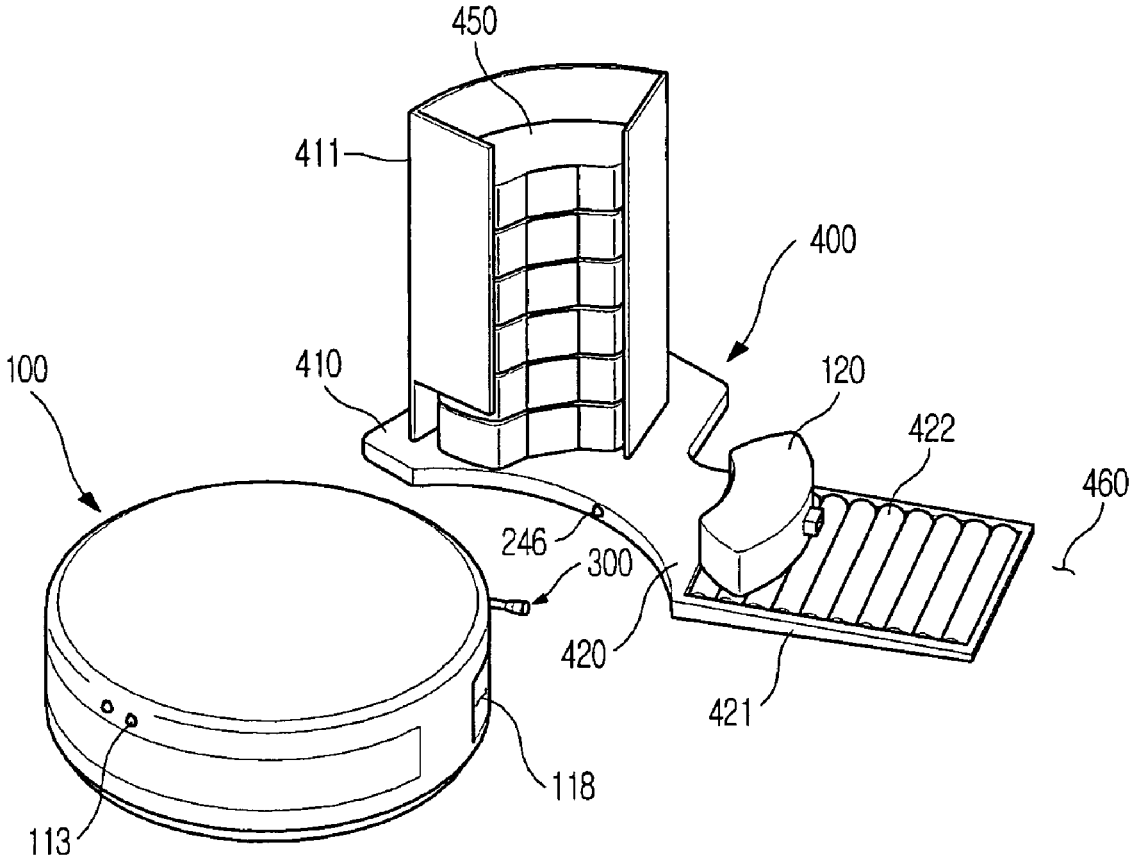
FIG. 7 is a perspective view illustrating a robot cleaning system according to a third embodiment of the present application.
Figure 8:
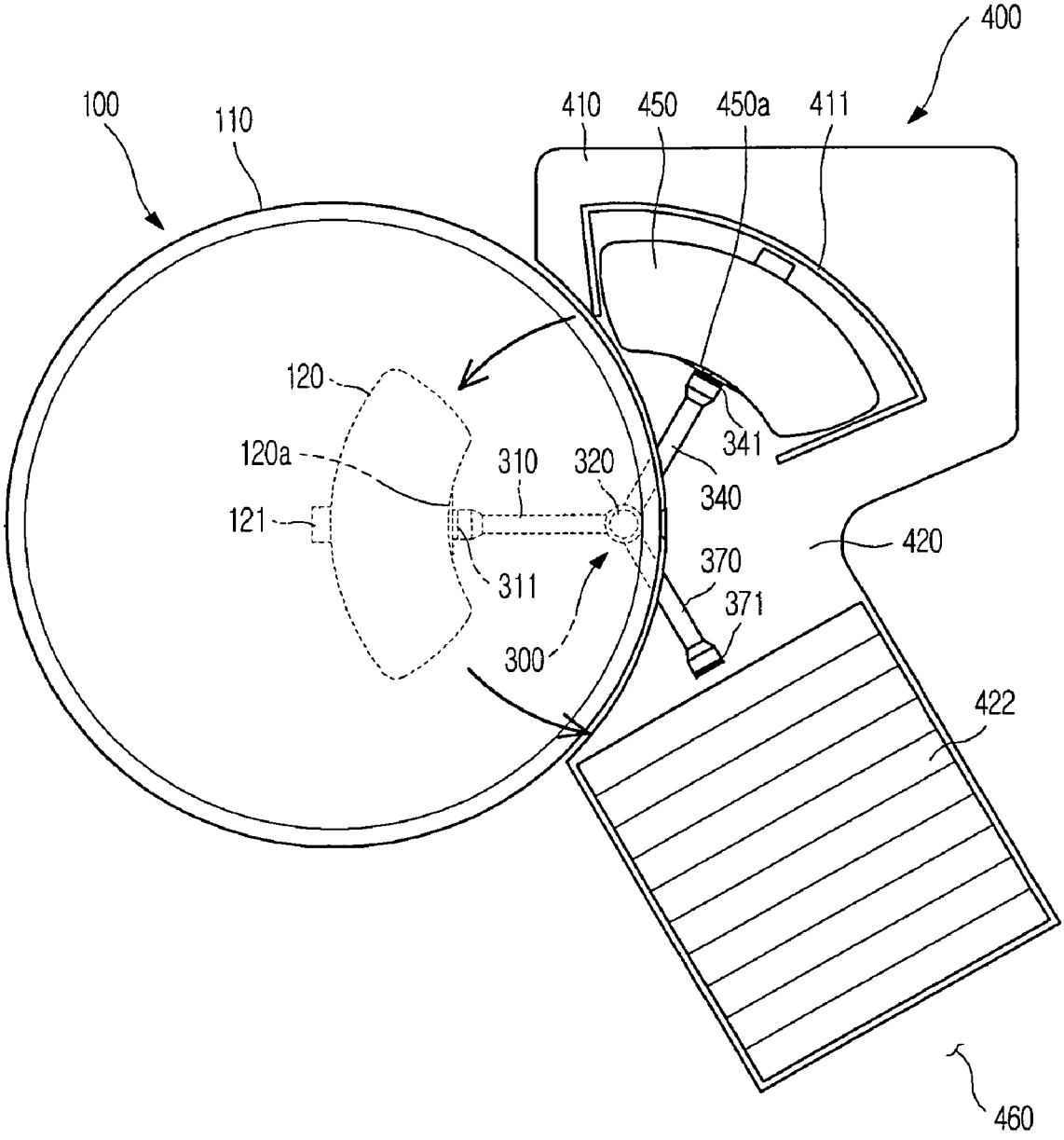
FIG. 8 is a plan view of the robot cleaning system shown in FIG. 7.

FIGS. 7 and 8 illustrate a robot cleaning system according to a third embodiment of the present application. Elements of the robot cleaning system according to the third embodiment, which are identical to those of the robot cleaning system according to the second embodiment, are denoted by the same reference numerals, and a description thereof will not be given.

As shown in FIGS. 7 and 8, the robot cleaning system according to the third embodiment includes a collector moving unit 300 to move a first dust collector 120 to a docking station 400, and move one of exchangeable dust collectors 450 loaded on the docking station 400 to a robot cleaner 100, such that the first dust collector 120 and the selected exchangeable dust collector 450 can be exchanged, so as to remove dust collected in the first dust collector 120 when the robot cleaner 100 is docked to the docking station 400.

The docking station 400 includes a loading table 410, on which a plurality of exchangeable dust collectors 450 are loaded such that the first dust collector 120 can be exchanged for one of the exchangeable dust collectors 450, and a discarding table 420, from which the first dust collector 120, which has been moved from the robot cleaner 100 to the docking station 400 by the collector moving unit 300, is discarded. At this time, the first dust collector 120 and each exchangeable dust collector 450 may be a disposable dust bag, for example. Also, the first dust collector 120 and each exchangeable dust collector 450 are constructed in the shape of an arc constituting a portion of a circumference having a connection part 320 of the collector moving unit 300 as the center thereof.

On the loading table 410 is mounted a loading guide 411, in which the exchangeable dust collectors 450 are loaded in a line. The discarding table 420 has an incline 421, along which the first dust collector 120 having dust collected therein is conveyed, without being placed on the discarding table 420, when the first dust collector 120 is moved to the docking station 400. A conveyor 422, for example, a roller-type conveyor is mounted on the incline 421.

On the other hand, the collector moving unit 300 is mounted in the robot cleaner 100 to move one of the exchangeable dust collectors 450 loaded on the loading table 410 into the robot cleaner 100, and, at the same time, move the first dust collector 120 mounted in the robot cleaner 100 to the discarding table 420 such that the selected exchangeable dust collector 450 and the first dust collector 120 can be exchanged.

The collector moving unit 300 includes an actuator 330, a connection part 320 connected to a rotary shaft of the actuator 330, and first, second, and third coupling parts 310, 340, and 370, which extend from the connection part 320 in the radial direction and are arranged at intervals of 120 degrees.

At the respective coupling parts 310, 340, and 370 are mounted attaching and detaching members 311, 341, and 371 to attach and detach the first dust collector 120 and the selected exchangeable dust collector 450 to and from the respective coupling parts 310, 340, and 370. In this embodiment, the attaching and detaching members 311, 341, and 371 are electromagnets. The first dust collector 120 and each exchangeable dust collector 450 have metal members **120*a* and 450*a*, respectively, which are attached to or detached from the attaching and detaching members 311, 341, and 371**.

Hereinafter, the operation of the robot cleaning system according to the third embodiment of the present application will be described with reference to FIG. 8.

When the robot cleaner 100 moves to perform cleaning, the first attaching and detaching member 311 is magnetized, and therefore, the first dust collector 120 is coupled to the first coupling part 310.

When a predetermined amount of dust is collected in the first dust collector 120 of the robot cleaner 100, the robot cleaner 100 returns to the docking station 400. When the robot cleaner 100 returns to a predetermined position, and a connection detector 152 detects that a connection terminal 151 of the robot cleaner 100 has been connected with a connection terminal 246 of the docking station 400, a controller 155 controls electric current to be supplied to the second attaching and detaching member 341. When the electric current is supplied to the second attaching and detaching member 341, the second attaching and detaching member 341 is magnetized, and therefore, one of the exchangeable dust collectors 450 is coupled to the second coupling part 340.

While the first dust collector 120 and the selected exchangeable dust collector 450 are coupled to the first and second coupling parts 310 and 340, respectively, the actuator 330 of the collector moving unit 300 is operated to rotate the first dust collector 120 and the selected exchangeable dust collector 450 by 180 degrees about the connection part 320. As a result, the first dust collector 120 of the robot cleaner 100 is moved to the discarding table 420 of the docking station 200. The selected exchangeable dust collector 450 is moved to the robot cleaner 100, and is then mounted in the robot cleaner 100.

In this state, the controller 155 prevents electric current from being supplied to the first attaching and detaching member 311. When the electric current is not supplied to the first attaching and detaching member 311, the first attaching and detaching member 311 is not magnetized. As a result, the first dust collector 120 is separated from the first coupling part 310. Subsequently, the robot cleaner 100 freely moves to clean dust on the floor while the exchangeable dust collector 450, which is empty, is mounted in the robot cleaner 100.

The first dust collector 120, which has been separated from the robot cleaner 100 and moved to the discarding table 420, is conveyed to a disposal area 460 by the conveyor 422 mounted at the incline 421.

As the above-described process is repeated, the exchangeable dust collectors 450 loaded on the loading table 410 are used one by one, and the dust collectors, in which dust is collected, are gathered in the disposal area 460. A user may dump the dust collectors gathered in the disposal area 460 at a dumping ground.

The robot cleaning system according to the third embodiment, in which the first dust collector 120 having dust collected inside is discarded, and a new, empty exchangeable dust collector 450 is mounted in the robot cleaner 100. This eliminates the need to mount the dust collector and the suction unit in the docking station. Therefore, it is possible to reduce the size of the docking station.

Also, a disposal dust bag is used as the dust collector, and, when dust has been collected in the dust bag, the dust bag can be easily and conveniently discarded. Consequently, the problem of the conventional art is fundamentally solved and effectively prevented, i.e., the leakage of dust and loose debris that occurs when dust is suctioned from the robot cleaner to the docking station.

Furthermore, like the robot cleaning system according to the second embodiment, the robot cleaning system according to the third embodiment has an advantage in that it is possible for the robot cleaner to immediately perform cleaning without being docked to the docking station and waiting until the dust collected in the dust collector of the robot cleaner is removed.

In the robot cleaner systems according to the first to third embodiments, the collector moving unit, which moves the dust collector, is mounted in the robot cleaner. However, the collector moving unit may be mounted in the docking station instead of the robot cleaner.

Furthermore, the dust collector is rotated about the rotary shaft in the illustrated embodiment. However, the dust collector may be linearly moved to the docking station.

As apparent from the above description, the robot cleaning system according to the present application moves the dust collector mounted in the robot cleaner to the docking station such that the collected dust in the dust collector of the robot cleaner can be suctioned directly into the dust collector of the docking station. Consequently, the total length of the suction channel, through which the dust is suctioned, is reduced, and therefore, a possibility that dust or loose debris is caught in the suction channel is reduced.

Also, the dust collector mounted in the robot cleaner can be easily exchanged. Consequently, it is possible for the robot cleaner to immediately return to cleaning without being docked to the docking station while waiting for the collected dust in the dust collector of the robot cleaner to be removed.

Furthermore, a disposable dust bag can be used as the dust collector in order for the dust collector to be exchanged. Consequently, it is not necessary to mount the dust collector and the suction unit in the docking station, and therefore, it is possible to reduce the size of the docking station. In addition, the leakage of dust and loose debris that occurs when dust is suctioned from the dust collector of the robot cleaner to the dust collector of the docking station is effectively prevented.

Although a few embodiments of the present application have been shown and described, it would be appreciated by those skilled in the art that changes may be made in these embodiments without departing from the principles and spirit of the application, the scope of which is defined in the claims and their equivalents.

What is claimed is:

1. A robot cleaning system, comprising:

a first dust collector to collect suctioned dust;

a robot cleaner having an opening, though which the first dust collector is carried in and out of the robot cleaner;

a docking station, to which the robot cleaner is docked to remove the dust collected in the first dust collector; and a collector moving unit to move the first dust collector to the docking station.

2. The system according to claim 1, wherein the collector moving unit includes an actuator comprising a rotary shaft, a connection part connected to the rotary shaft, and a first coupling part extending from the connection part in a radial direction to be coupled with the first dust collector.

3. The system according to claim 2, wherein the docking station includes a second dust collector having a suction port, to suction the dust in the first dust collector, the first dust collector having a first port to couple to the second dust collector, and a guide member to guide the coupling between the first port and the suction port when the collector moving unit rotates and moves the first dust collector to the docking station.

4. The system according to claim 3, further comprising:

a third dust collector having a same size and shape as the first dust collector and being coupled with the second dust collector;

wherein the guide member has a location part on which the third dust collector is located.

5. The system according to claim 4, wherein the collector moving unit further includes a second coupling part extending from the connection part in a direction opposite to the first coupling part, whereby the first dust collector is moved to the docking station, and the third dust collector is moved to the robot cleaner such that the first and third dust collectors are exchanged.

6. The system according to claim 5, wherein the first coupling part and the second coupling part each have attaching and detaching members to attach and detach the first dust collector and the third dust collector to and from the first coupling part and the second coupling part, respectively.

7. The system according to claim 6, wherein the attaching and detaching members are electromagnets, and the first dust collector and the third dust collector each have metal members formed at predetermined positions thereof, the metal members being attached to and detached from the corresponding attaching and detaching members.

8. The system according to claim 2, further comprising:

a plurality of exchangeable dust collectors;

wherein the docking station includes:

a loading table on which the plurality of exchangeable dust collectors are loaded such that the first dust collector can be exchanged for at least one of the exchangeable dust collectors, and a discarding table, from which the first dust collector, which has been moved from the robot cleaner to the docking station by the collector moving unit, is discarded, and the collector moving unit moves the first dust collector to the discarding table, and mounts one of the exchangeable dust collectors in the robot cleaner, whereby the first dust collector is exchanged.

9. The system according to claim 8, wherein the collector moving unit further includes second and third coupling parts, which are arranged such that the second and third coupling parts are arranged at intervals of 120 degrees with the first coupling part about the connection part.

10. The system according to claim 9, wherein the respective coupling parts each have attaching and detaching members to attach and detach the first dust collector and the exchangeable dust collector to and from the respective coupling parts.

11. The system according to claim 9, wherein the first dust collector and the exchangeable dust collectors are disposable dust bags.

12. The system according to claim 8, wherein the docking station further includes a conveyor to convey the first dust collector, which has been moved to the discarding table, to a disposal area.

13. The system according to claim 8, wherein the first dust collector and the exchanged dust collectors are constructed in the shape of an arc constituting a portion of a circumference having the connection part as the center thereof.

14. A robot cleaner system, comprising:

a robot cleaner having a first dust collector to collect suctioned dust, an opening, through which the first dust collector is conveyed in and out of the robot cleaner and having a first port for the first dust collector;

a docking station having a second dust collector to suction the dust collected in the first dust collector when the robot cleaner is docked to the docking station and a suction port for the second dust collector; and a collector moving unit to move the first dust collector such that the first port of the first dust collector is coupled to the suction port of the second dust collector.

15. The system according to claim 14, wherein the collector moving unit includes an actuator having a rotary shaft, a connection part connected to the rotary shaft, and a first coupling part extending from the connection part in a radial direction to be coupled with the first dust collector, whereby the collector moving unit rotates and moves the first dust collector.

16. A robot cleaner system, comprising:

a robot cleaner having a first dust collector to collect suctioned dust;

a docking station having a second dust collector to collect suctioned dust;

a third dust collector located on the docking station and coupled to the second dust collector; and a collector moving unit to exchange the first dust collector and the third dust collector when the robot cleaner is docked to the docking station.

17. The system according to claim 16, wherein the collector moving unit includes an actuator having a rotary shaft, a connection part connected to the rotary shaft of the actuator, a first coupling part extending from the connection part in a radial direction to be coupled with the first dust collector, and a second coupling part extending from the connection part in the direction opposite to the first coupling part, the second coupling part being coupled to the third dust collector.

18. The system according to claim 17, wherein the respective coupling parts each have attaching and detaching members to attach and detach the first dust collector and the third dust collector to and from the respective coupling parts.

19. The system according to claim 18, wherein the attaching and detaching members are electromagnets, and the first dust collector and the third dust collector each have metal members formed at predetermined positions thereof, the metal members being attached to and detached from the corresponding attaching and detaching members.

20. A robot cleaner system, comprising:

a robot cleaner having a first dust collector to collect suctioned dust;

a docking station having a loading table, on which a plurality of exchangeable dust collectors are loaded, and a discarding table, from which the first dust collector, which has been moved from the robot cleaner to the docking station, is discarded; and a collector moving unit to move the first dust collector to the discarding table and move one of the exchangeable dust collectors to the robot cleaner.

21. The system according to claim 20, wherein the collector moving unit includes an actuator having a rotary shaft, a connection part connected to the rotary shaft, and first, second, and third coupling parts extending from the connection part in a radial direction and arranged at intervals of 120 degrees.

22. The system according to claim 21, wherein the respective coupling parts have attaching and detaching members to attach and detach the first dust collector and the moved exchangeable dust collector to and from the respective coupling parts.

23. The system according to claim 20, wherein the first dust collector and the exchangeable dust collectors are disposable dust bags.

24. A dust removing method of a robot cleaner system, comprising:

determining whether a predetermined amount of dust has been collected in a first dust collector mounted in a robot cleaner;

moving the robot cleaner to a docking station;

determining whether the robot cleaner has been docked to the docking station;

moving the first dust collector to the docking station such that the first dust collector communicates with a second dust collector mounted in the docking station, operating a suction unit such that the dust in the first dust collector is suctioned into the second dust collector;

determining whether the dust in the first dust collector has been removed; and controlling the suction unit not to be operated, and moving the first dust collector to the robot cleaner.

25. A dust removing method of a robot cleaner system, comprising:

determining whether a predetermined amount of dust has been collected in a first dust collector mounted in a robot cleaner;

moving the robot cleaner to a docking station having a plurality of exchangeable dust collectors when the predetermined amount of collected dust is in the first dust collector; and exchanging the first dust collector for at least one of the exchangeable dust collectors located on the docking station comprising using a collector moving unit mounted in the robot cleaner.

26. The method according to claim 25, wherein the exchanging the first dust collector mounted in the robot cleaner for at least one of the exchangeable dust collectors located on the docking station comprises:

coupling one of the exchangeable dust collectors located on the docking station to the collector moving unit;

rotating the first dust collector mounted in the robot cleaner to the docking station and one of the exchangeable dust collectors to the robot cleaner using the collector moving unit;

separating the first dust collector from the collector moving unit to mount one of the exchangeable dust collectors in the robot cleaner; and separating the first dust collector from the collector moving unit to mount the first dust collector in the docking station.

27. A dust removing method of a robot cleaner system, comprising:

determining whether a predetermined amount of dust has been collected in a first dust collector mounted in a robot cleaner;

moving the robot cleaner to a docking station;

moving the first dust collector to the docking station and moving an exchangeable dust collector mounted in the docking station to the robot cleaner such that the dust collectors are exchanged; and conveying the first dust collector, which has been moved to the docking station, to a disposal area.

28. The system according to claim 2, wherein the first dust collector is rotated about the rotary shaft to the docking station.

29. The system according to claim 2, wherein the first dust collector is rotated about the rotary shaft to the collector moving unit.

30. The system according to claim 2, wherein the first dust collector is linearly moved to the docking station.

31. The system according to claim 5, wherein the rotary shaft of the actuator rotates to move the first dust collector to the docking station and the third dust collector to the robot cleaner such that the first and third dust collectors are exchanged.

32. The system according to claim 17, wherein the rotary shaft of the actuator rotates to move the first dust collector to the docking station and the third dust collector to the robot cleaner such that the dust collectors are exchanged.

33. A robot cleaning system, comprising:

a robot cleaner having a first dust collector to collect suctioned dust;

a docking station having a plurality of replacement dust collectors stored thereon; and a collector moving unit having a rotary shaft to move the first dust collector to the docking station and at least one of the dust collectors to the robot cleaner.

34. The system according to claim 33, wherein the first dust collector and at least one of the replacement dust collectors are exchanged when the rotary shaft rotates.

* * * * *

UNITED STATES PATENT AND TRADEMARK OFFICE

CERTIFICATE OF CORRECTION

PATENT NO. : 7,849,555 B2
APPLICATION NO. : 11/644934
DATED : December 14, 2010
INVENTOR(S) : Jung Yoon Hahm et al.

It is certified that error appears in the above-identified patent and that said Letters Patent is hereby corrected as shown below:

Column 12, Line 32, In Claim 1, delete “though” and insert --through--, therefor.

Signed and Sealed this
Twenty-second Day of March, 2011

David J. Kappos

David J. Kappos
*Director of the United States Patent and Trademark Office*